US006446929B1

(12) United States Patent
Scott et al.

(10) Patent No.: US 6,446,929 B1
(45) Date of Patent: Sep. 10, 2002

(54) DUAL ROTATABLE BOOK HOLDER

(76) Inventors: Sandra L. Scott, 27401 Newporter Way, Laguna Niguel, CA (US) 92677; John Paul Scott, 27401 Newporter Way, Laguna Niguel, CA (US) 92677

( * ) Notice: Subject to any disclaimer, the term of this patent is extended or adjusted under 35 U.S.C. 154(b) by 0 days.

(21) Appl. No.: 09/799,871

(22) Filed: Mar. 5, 2001

(51) Int. Cl.[7] ..... A47B 97/04
(52) U.S. Cl. ..... 248/458; 248/453
(58) Field of Search ..... 248/453, 446, 248/460, 349.1, 131, 425, 458; 40/606, 611, 120, 666

(56) References Cited

U.S. PATENT DOCUMENTS

| | | | | | |
|---|---|---|---|---|---|
| 181,737 | A | * | 8/1876 | Smith | 248/458 |
| 632,037 | A | * | 8/1899 | Bauer | 248/458 |
| 2,144,856 | A | * | 1/1939 | Sawyer | 248/458 |
| 2,707,350 | A | * | 5/1955 | Schaffner | 45/81 |
| 5,025,353 | A | * | 6/1991 | Menaged | 362/98 |
| 5,067,682 | A | * | 11/1991 | Figaro | 248/453 |
| 5,639,053 | A | * | 6/1997 | Dmitriev | 248/460 |
| 5,690,310 | A | * | 11/1997 | Brown | 248/448 |
| 5,720,465 | A | * | 2/1998 | Peltzer et al. | 248/453 |
| 5,720,466 | A | * | 2/1998 | Skipper | 248/460 |
| 5,765,799 | A | * | 6/1998 | Weber | 248/453 |

* cited by examiner

*Primary Examiner*—Ramon O. Ramirez
*Assistant Examiner*—Kofi Schulterbrandt
(74) *Attorney, Agent, or Firm*—Rob L. Phillips; Quirk & Tratos

(57) ABSTRACT

A dual rotatable book holder designed to hold two books for quick and easy reference. Two plates form a two face book platform with lips extending outwardly hold two books back-to-back. The two face book platform is removably engaged with a rotatable base allowing the user to quickly and efficiently rotate the two face book platform. The rotatable base comprises an upper section and a lower section which snap-fit together. The fitted upper section and lower section form a circular enclosure which encases one or more sets of ball bearings allowing the upper section to rotate freely upon the stationary lower section. The ball bearings are held in place by slots incorporated within a channel of the upper section and a groove in the lower section. A pin and tubular section arrangement connect the two plates and hinges connect the lips to the two plates allowing the two surface book platform to be folded into a flat piece when removed from the base for easy storage along with the flat base.

9 Claims, 7 Drawing Sheets

DUAL ROTATABLE BOOK HOLDER

FIELD OF THE INVENTION

The present invention relates to a book holder capable of holding two books simultaneously. Two plates form a two surface book platform that is removably engaged to a rotatable base allowing a user to quickly and simply refer to two books. The two surface book platform is designed such that the pages of the two books are held in place with adjustable clips connected to lips attached to the two plates creating a hands-free reading environment for the user When not in use the two surface book platform can be removed from the rotatable base and folded for easy storage along with the base.

BACKGROUND OF THE INVENTION

Book reading has become an extremely integral part of everyday life in many countries of the world. People read books for enjoyment, for reference and out of necessity for a chosen career path. No matter what the reason, making it convenient to read books is an important aspect of many inventions and issued patents.

In the past it was common to simply place a book on a table or hold it while reading. However, as time passed it became apparent that placing books in a more upright position allowed a reader more flexibility. The devices for holding books in an upright position are usually referred to as "book holders." Book holders normally include a means for holding the pages of a book stationary and open so that the reader can observe the pages while leaving his or her hands free. The book holders in use today allow the user great flexibility in book position and location.

U.S. Pat. Nos. 5,433,415, 5,649,683, 5,720,465, 5,755,423, 5,855,329, 5,893,546, 5,979,940 and 6,068,299 all disclose book holders for placing a book in an upright position with means for holding the pages of a book stationary and open. The patents are similar in that they all disclose book holders that hold one book in an upright position on a generally flat surface and allow the reader the ability to read a book while his or her hands are free. U.S. Pat. No. 5,979.940 includes a light for the convenience of the reader while U.S. Pat. No. 5,433,415 includes a mechanical page turner. The methods of accomplishing the book holding objective are different throughout the list of patents but the end result is the same.

U.S. Pat. Nos. 5,351,927, 5,671,900, 5,690,310, 5,908,207 and 5,979,857 are also directed to book holders but they allow the user the ability to dramatically alter the position and location of the book while it is being held in place. Each of the patents includes an adjustable stand and adjustable arm connected thereto which allows the user to change the position and location of one book throughout the entire three dimensional spectrum. Again, lights and other features differentiate the patents but the end result is the same.

The long list of patents disclosed herein overlooks a critical feature necessary in the ever changing 21$^{st}$ century. Each and every, book holder patent listed herein and otherwise is directed to use with one book. Therefore, a user requiring two or more books is required to change the book being held in place each and every time that they desire to refer to a different book. Further, the patents that allow the user to change the position and location of the book are usually bulky and time consuming to adjust.

The present invention solves the inherent problems with past book holders by allowing the user to hold two or more books in place and further allows the user quick and simple access to each of the books. The present invention is designed so that it rotates on a generally flat surface thereby allowing the reader to refer to each of the books in a split second if necessary.

Both adamant readers and those career types who must refer to more than one book on a regular basis will find the invention disclosed herein extremely useful and novel. Doctors, lawyers, engineers and the like will discover that the unique dual rotatable book holder is a significant time-saver and convenient method of referring to more than one book at a time Professionals need simply spin the dual rotatable book holder for quick and easy access to one or more books.

SUMMARY OF THE INVENTION

Accordingly, the present novel invention comprises a dual rotatable book holder capable of holding two or more books simultaneously and further capable of rotation for quick and simple access to the books.

The dual rotatable book holder consists of a two surface book platform for book support and includes lips for distributing the book weight. Book marks integrated as a portion of the lips are used to mark the book pages. The two surface book platform is removably engaged with a rotatable base. The removable engagement between the two surface book platform and the rotatable base allows the present invention to be taken apart into two pieces and easily stored.

Other objects, features and advantages of the present invention will be readily apparent from the following description of certain preferred embodiments. It is understood that modifications and variations may be effectuated without departing from the spirit and scope of the present invention.

DETAILED DESCRIPTION OF THE PREFERRED EMBODIMENTS

Figure 1:
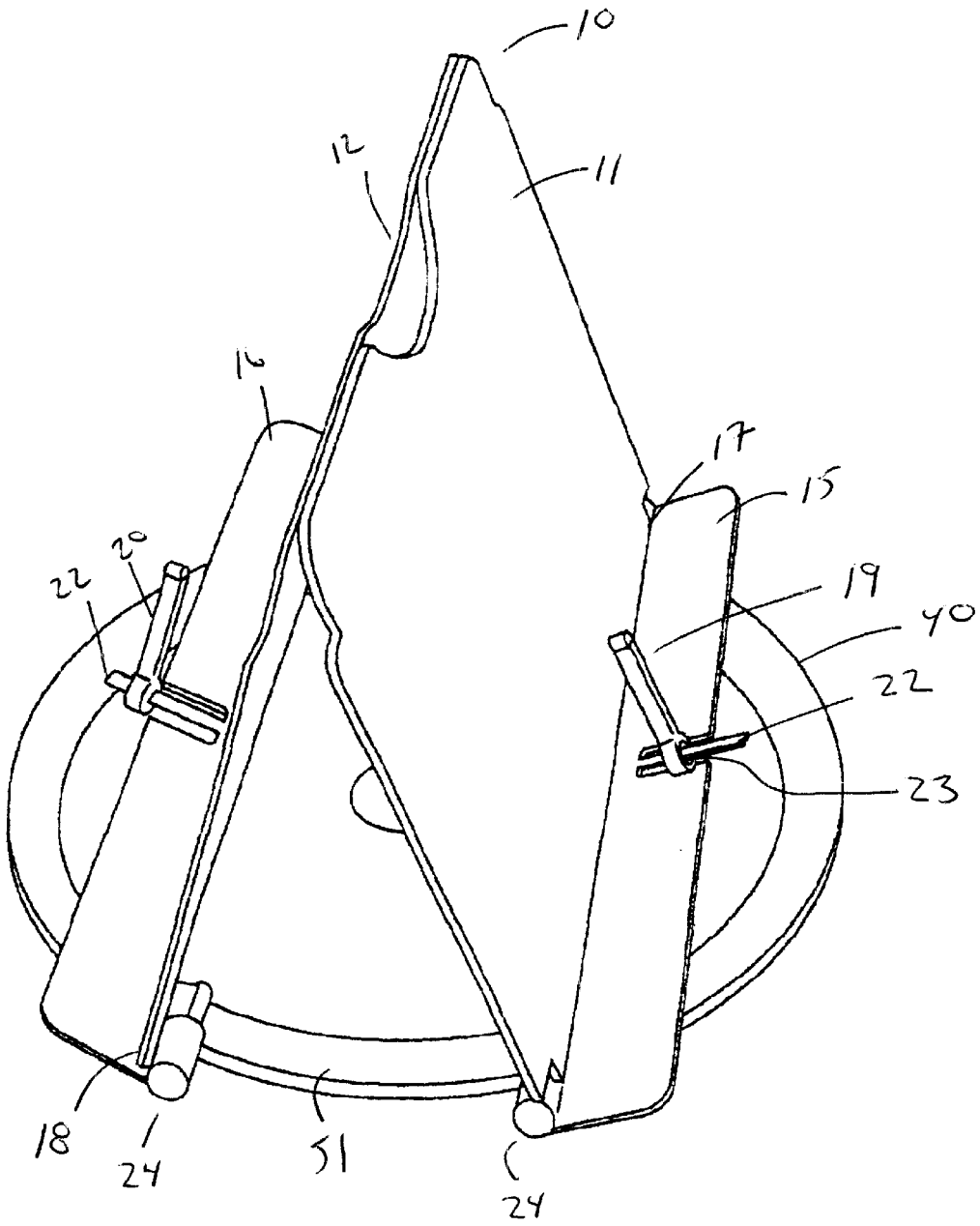
FIG. 1. is a perspective view of the preferred embodiment of the present invention.
Figure 2:
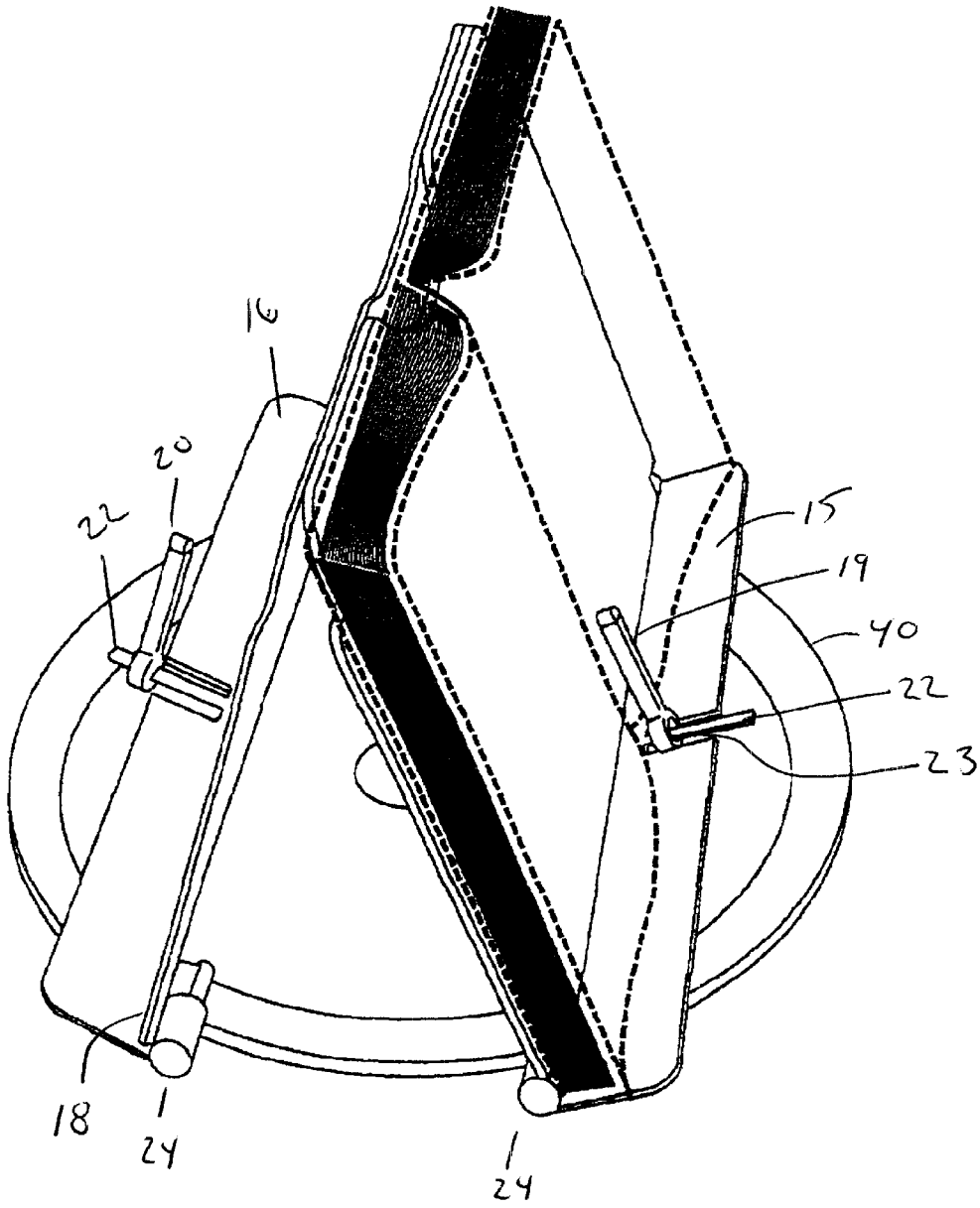
FIG. 2. is a perspective view of the preferred embodiment of the present invention illustrating its use.
Figure 3:
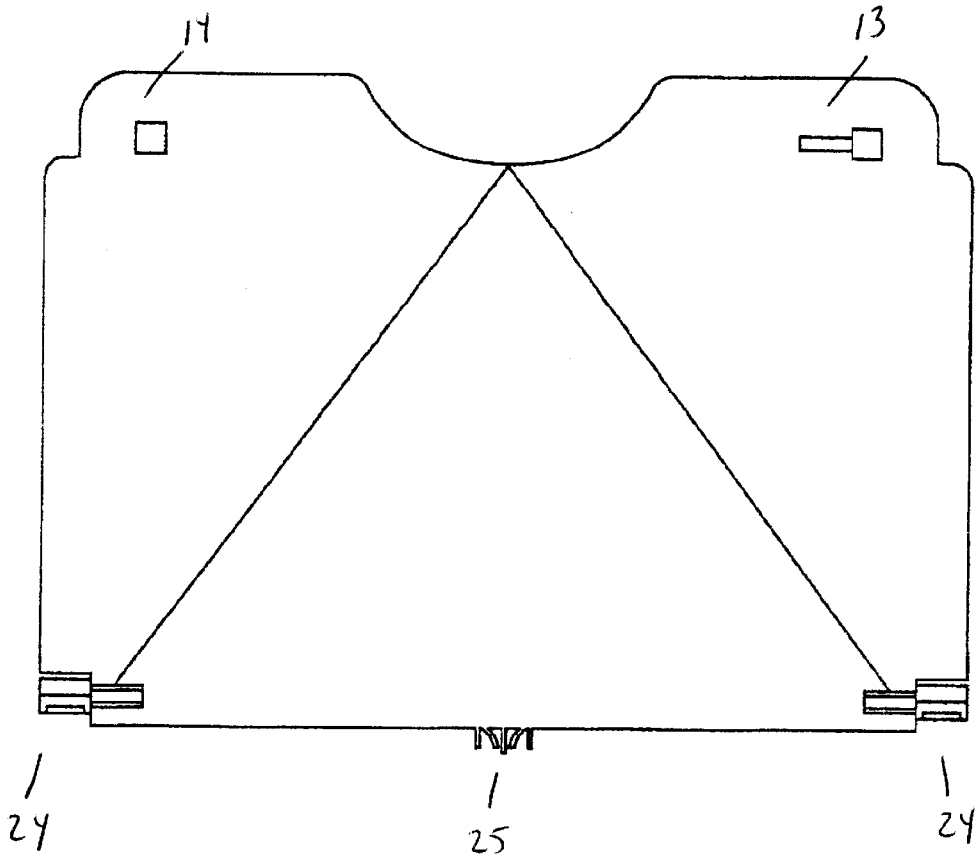
FIG. 3. is a back view of the plate forming the book platform of the present invention.

Referring to FIGS. 1, 2, & 3 the preferred embodiment of the dual rotatable book holder comprises a two surface book platform 10 and a base 40.

The two surface book platform 10 consists of a first plate 11 and a second plate 12 removably connected by a pin 13 on an inner surface of the first plate 11 and the second plate 12 that inserts into a corresponding tubular section 14 on an inner surface of the first plate 11 and second plate 12.

The two surface book platform 10 further consists of a first lip 15 and a second lip 16 for distributing the weight of books. The first lip 15 and second lip 16 extend from a lower edge 17 of the first plate 11 and a lower edge 18 of the second plate 12 forming a shelf for resting the books during use. The first lip 15 and the second lip 16 are connected to the first plate 11 and the second plate 12 by hinges 24. The hinged arrangement allows the user to change the angle of the lips 15, 16 with respect to the first plate 11 and second plate 12 creating the most stable system for distributing the weight of the particular book. The hinged arrangement also allows the lips 15, 16 to be folded in against the first plate 11 and the second plate 12 when the present invention is not in use.

Book marks 19, 20 are separate individual pieces that attach to the lips 15, 16. By means of a circular opening 23 at one end, the book marks 19, 20 removably slide upon a length of a rigid extension 22 from the lips 15, 16 at the approximate mid-point of the lips 15, 16. In their full inward position the book marks 19, 20 rest against a lower crease of the books causing a required page to be saved.

The first plate 11 and the second plate 12 each include a series of latches 25 which protrude from the lower edges 17, 18 of the plates 11, 12. In order to connect the book platform 10 to the base 40. the latches 25 penetrate rectangular elevated voids 11 in an upper section 50 of the base 40 creating a secure connection between the two surface book platform 10 and the base 40. This arrangement creates a secure structure and allows for easy removal of the two surface book platform 10 from the base 40 at which time the two surface book platform 10 can be stored along with the flat base 40. It is envisioned, but not shown. that a series of elevated voids similar to voids 31 can be placed radially outward along the upper section 50 allowing the user to adjust the book platform 10 and the angle of the plates 11, 12.

Figure 4:
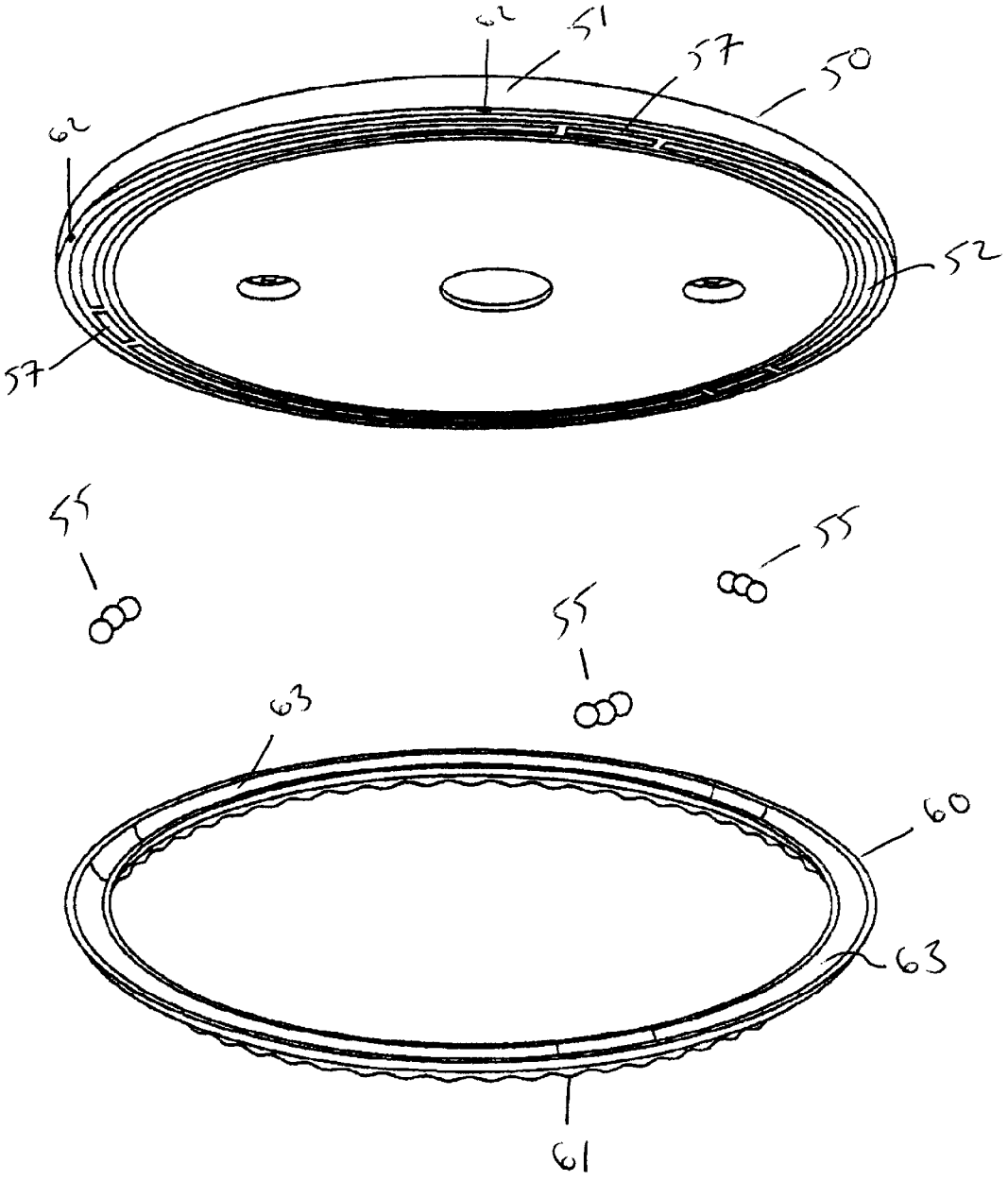
FIG. 4. is an exploded view of the rotatable base.
Figure 5:
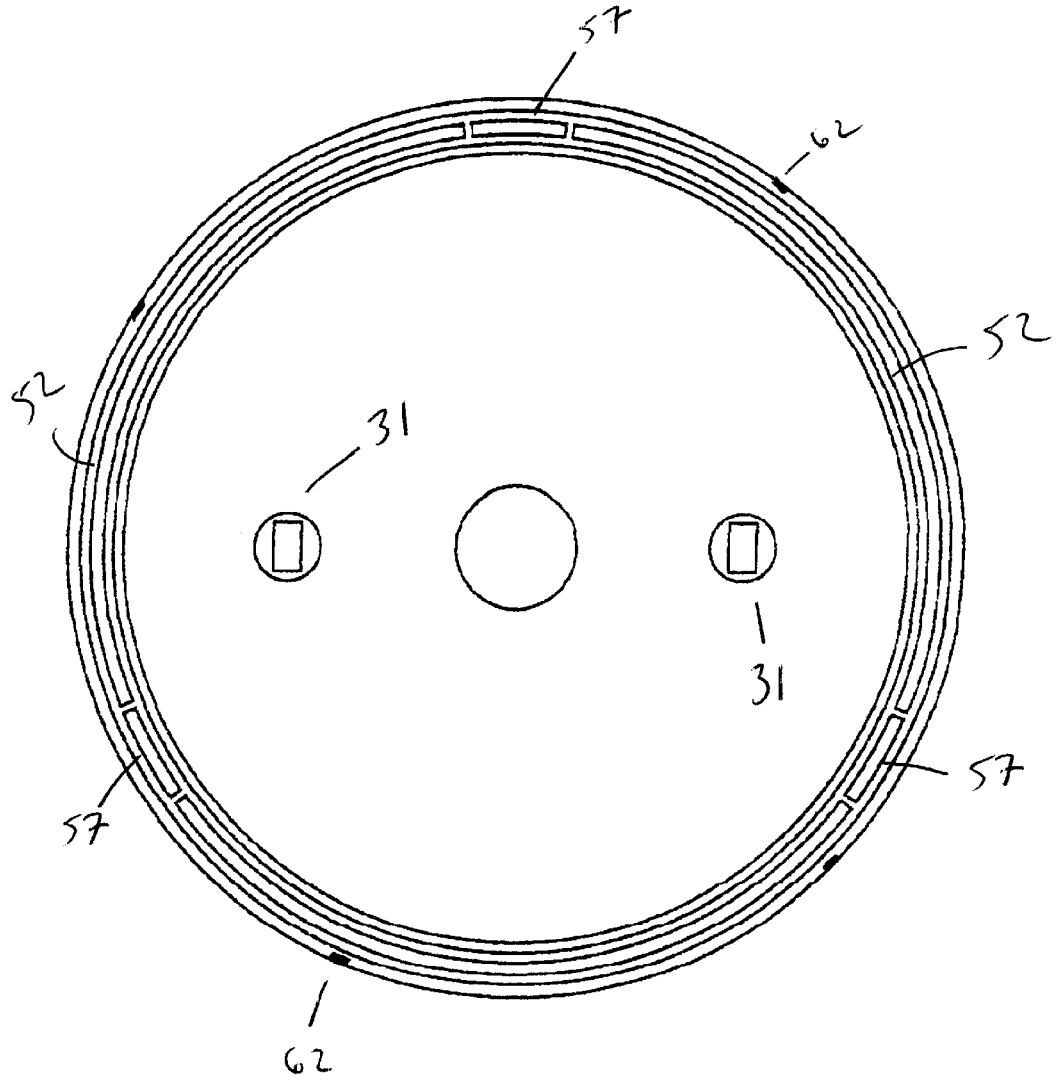
FIG. 5. is an under-side view of the upper section of the base of the present invention.
Figure 6:
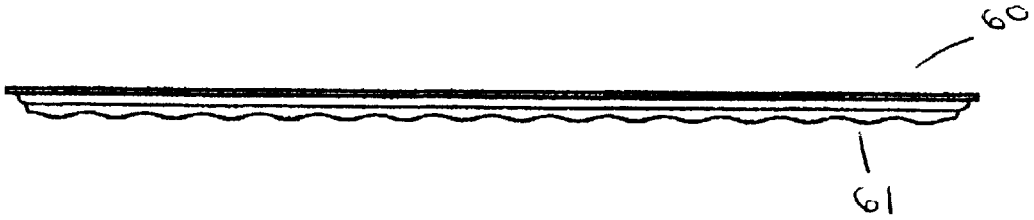
FIG. 6. is a side view of the lower section of the base of the present invention.
Figure 7:
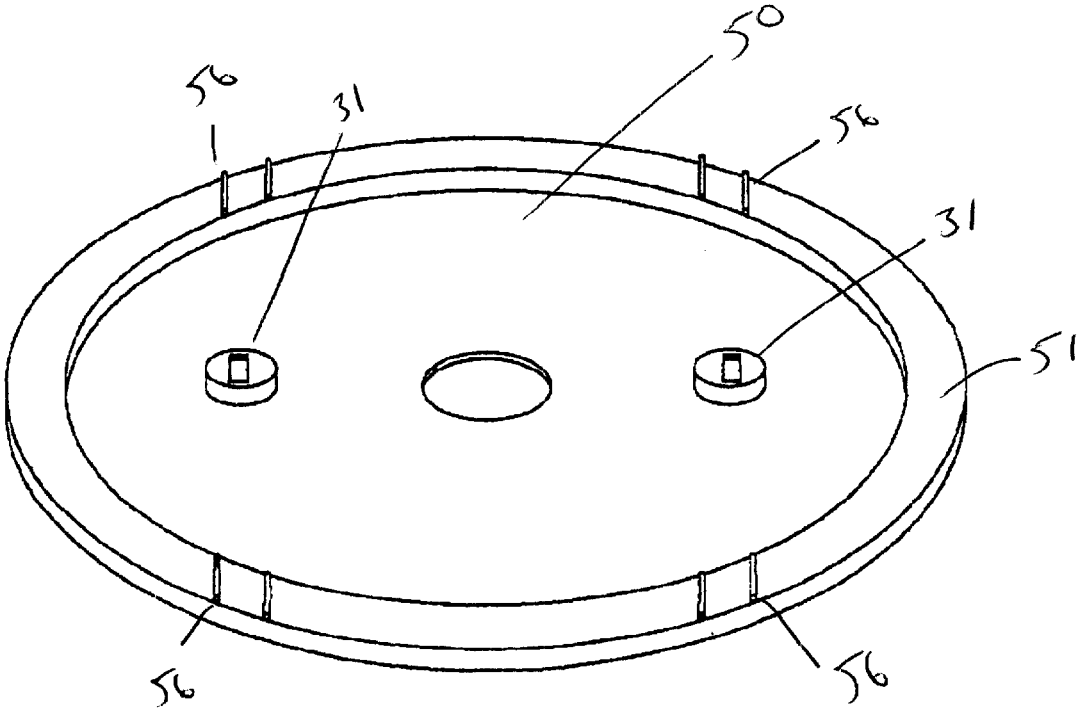
FIG. 7. is a perspective view of the upper section of the base of the present invention.

Referring to FIGS. 4, 5 & 6, the base 40 is comprised of the upper section 50 and a lower section 60. The upper section 50 is circular, much like a plate or frisbee., and includes a raised portion 51 running, its entire outer circumference. From an under-side of the upper section 50 the raised portion 51 forms a channel 52 that contains the lower section 60. The lower section 60 is a circular ring with a width approximately equivalent to the channel 52 formed by the raised portion 51 of the upper section 50. The lower section 60 has a semi-circular cross-section and further includes a protruding ridge 61 that runs the circumference of its under-side. When in use the present invention rests on the ridge 61. The upper section 50 includes a series of clips 62 extending radially inward at a point along the channel 52 so that when fitted with the lower section 60 the clips 62 overlap the lower section 60 causing the upper section 50 and the lower section 60 to be "snap-fitted" together. A top-side of the upper section 50 includes a series of raised slots 56, along its raised portion, that receive the lower edge 17 of the first plate 11 and a lower edge 18 of the second plate 12 resulting in a very stable system.

In order to render the dual book holder rotatable. ball bearings 55 are encased by the upper section 50 and the lower section 60. The ball bearings 55 are placed in groups of one or more in slots 57 incorporated on the under-side of the upper section 50. The slots 57 are integrated into the channel 52 of the upper section 50. When snap-fitting the upper section 50 and the lower section 60 a groove 63 formed by the semi-circular lower section 60 encases the ball bearings 55 allowing the upper section 50 of the base 40 to freely rotate upon the stationary lower section 60.

In the preferred embodiment the entire dual rotatable book holder will be constructed of plastic utilizing an injection molding process. However, those skilled in the art will realize any number of materials or processes can be utilized without departing from the spirit and scope of the present invention.

What is claimed is:

1. A dual rotatable book holder comprising:

a means for removably connecting a first plate to a second plate to form a two surface book platform, including lips attached to, and extending outward from, lower edges of the two plates, all removably engaged to a rotatable base, and the means for connecting the first plate to second plate is a first pin on an inner surface of the first plate that inserts into a first corresponding tubular section on an inner surface of the second plate and a second pin on an inner surface of the second plate that inserts into a second corresponding tubular section on an inner surface of the first plate.

2. The dual rotatable book holder defined in claim 1 wherein the lips are hinged to the lower edges of the two plates.

3. The dual rotatable book holder defined in claim 1 wherein each lip includes a rigid extension at its approximate mid-point that receives a book mark that includes a means of removably sliding upon the length of the rigid extension.

4. The dual rotatable book holder as defined in claim 1 wherein the base is comprised of an upper section and a lower section, said upper section is circular and includes a raised portion running its entire outer circumference, from the under-side of the upper section the raised portion forms a channel the lower section fits into, the lower section is a circular ring with a width approximately equivalent to the channel formed by the raised portion of the upper section and has a semi-circular cross-section.

5. The dual rotatable book holder as defined in claim 4 wherein a plurality of ball bearings are encased by the upper section and the lower section and are held in place by slots incorporated within the channel of the upper section and the groove in the lower section.

6. The dual rotatable book holder as defined in claim 4 wherein the first plater and the second plate include a series of latches which protrude from lower edges of the plates, said latches each penetrating one of a plurality of elevated slots in an upper section of the base securing the book platform to the base.

7. The dual rotatable book holder as defined in claim 4 wherein the upper section includes one or more clips which extend radially inward at points along a channel and which overlap the lower section of the base.

8. The dual rotatable book holder as defined in claim 4 wherein the lower section includes a protruding ridge along its under-side.

9. The dual rotatable book holder as defined in claim 4 wherein a top-side of the upper section includes a series of elevated slots for receiving lower edges of said plates.

* * * * *

UNITED STATES PATENT AND TRADEMARK OFFICE

CERTIFICATE OF CORRECTION

PATENT NO. : 6,446,929 B1
DATED : September 10, 2002
INVENTOR(S) : Scott et al.

It is certified that error appears in the above-identified patent and that said Letters Patent is hereby corrected as shown below:

Column 4,
Line 15, change "," to -- ; --
Line 46, change "plater" to -- plate --

Signed and Sealed this

Eleventh Day of February, 2003

JAMES E. ROGAN
*Director of the United States Patent and Trademark Office*